US011447898B2

(12) United States Patent
Amis et al.

(10) Patent No.: US 11,447,898 B2
(45) Date of Patent: Sep. 20, 2022

(54) CIRCULAR KNITTED GARMENT WITH APERTURES

(71) Applicant: NIKE, Inc., Beaverton, OR (US)

(72) Inventors: Hannah R. Amis, Portland, OR (US); Amy Lyttle, Portland, OR (US); Ronen Yehuda, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 62 days.

(21) Appl. No.: 16/704,868

(22) Filed: Dec. 5, 2019

(65) Prior Publication Data

US 2020/0109495 A1 Apr. 9, 2020

Related U.S. Application Data

(63) Continuation of application No. 15/585,405, filed on May 3, 2017, now Pat. No. 10,519,577.

(60) Provisional application No. 62/332,175, filed on May 5, 2016.

(51) Int. Cl.
*D04B 1/10* (2006.01)
*D04B 1/26* (2006.01)

(52) U.S. Cl.
CPC ..... *D04B 1/104* (2013.01); *D04B 1/26* (2013.01)

(58) Field of Classification Search
CPC . D04B 1/104; D04B 1/26; D04B 9/20; D04B 9/26; D04B 9/46; D04B 9/38
See application file for complete search history.

(56) References Cited

U.S. PATENT DOCUMENTS

| | | | | |
|---|---|---|---|---|
| 1,805,035 A | | 5/1931 | Branley | |
| 1,883,581 A | | 10/1932 | Cole | |
| 1,922,977 A | | 8/1933 | Page | |
| 1,932,292 A | | 10/1933 | Sheppard | |
| 2,892,330 A | * | 6/1959 | Klahr | D04B 1/26 66/14 |

(Continued)

FOREIGN PATENT DOCUMENTS

| | | |
|---|---|---|
| CN | 1060509 A | 4/1992 |
| CN | 1494611 A | 5/2004 |

(Continued)

OTHER PUBLICATIONS

Intention to Grant received for European Patent Application No. 17723866.4, dated Mar. 9, 2021, 7 pages.

(Continued)

*Primary Examiner* — Danny Worrell
(74) *Attorney, Agent, or Firm* — Shook Hardy & Bacon, LLP

(57) ABSTRACT

Present aspects hereof are directed to a circular knitted garment, such as a sock, or a sleeve. The garment has at least a first segment with multiple knit courses, and a second segment having the same number of multiple knit courses as the first segment. The garment has an aperture separating the first segment and the second segment, where the aperture is occupied by a single strand of yarn extending from the first segment to the second segment. The first and second segments are formed by changing the circular knitting direction from one course to the next course in a reciprocating fashion, until the last course is formed, wherein the single strand of yarn moves from the last course in the current segment to the first course in a next, adjacent segment.

18 Claims, 7 Drawing Sheets

(56) References Cited

U.S. PATENT DOCUMENTS

| | | | | |
|---|---|---|---|---|
| 3,003,343 | A | 10/1961 | Alfano | |
| 3,142,974 | A | 8/1964 | Fregeolle | |
| 3,247,685 | A * | 4/1966 | Fregeolle | D04B 9/46 66/43 |
| 3,601,818 | A | 8/1971 | Chesebro et al. | |
| 4,057,981 | A | 11/1977 | Runac | |
| 4,126,903 | A | 11/1978 | Horton | |
| 4,195,497 | A | 4/1980 | Goldstein et al. | |
| 4,253,317 | A | 3/1981 | Howard et al. | |
| 4,898,007 | A | 2/1990 | Dahlgren | |
| 5,724,836 | A | 3/1998 | Green | |
| 6,170,299 | B1 | 1/2001 | Apollonio | |
| 6,257,025 | B1 | 7/2001 | Fray | |
| 6,321,578 | B1 | 11/2001 | Apollonio | |
| 6,324,874 | B2 | 12/2001 | Fujimoto | |
| 6,539,752 | B1 * | 4/2003 | Apollonio | D04B 1/104 66/180 |
| 6,871,515 | B1 * | 3/2005 | Starbuck | D04B 1/104 66/169 R |
| 7,069,751 | B2 | 7/2006 | Apollonio | |
| 7,389,657 | B2 | 6/2008 | Lonati et al. | |
| 7,587,915 | B2 | 9/2009 | Kaneda | |
| 7,614,257 | B2 | 11/2009 | Araki et al. | |
| 7,757,517 | B2 | 7/2010 | Malloy | |
| 9,732,451 | B2 * | 8/2017 | Lee | D04B 15/02 |
| 10,519,577 | B2 | 12/2019 | Amis et al. | |
| 2009/0118685 | A1 | 5/2009 | Choi et al. | |
| 2011/0035863 | A1 | 2/2011 | Lambertz | |
| 2015/0052654 | A1 | 2/2015 | Thom | |

FOREIGN PATENT DOCUMENTS

| | | | |
|---|---|---|---|
| CN | 2666193 | Y | 12/2004 |
| CN | 101821539 | A | 9/2010 |
| CN | 104342841 | A | 2/2015 |
| CN | 105133161 | A | 12/2015 |
| CN | 109154114 | A | 1/2019 |
| EP | 1 375 718 | A1 | 1/2004 |
| EP | 1 776 879 | A2 | 4/2007 |
| EP | 3452649 | A1 | 3/2019 |
| GB | 556084 | A | 9/1943 |
| JP | 2001-295104 | A | 10/2001 |
| JP | 2002-339202 | A | 11/2002 |
| JP | 2003-119601 | A | 4/2003 |
| KR | 10-0836294 | B1 | 6/2008 |
| KR | 10-1149673 | B1 | 5/2012 |
| WO | 92/07128 | A1 | 4/1992 |
| WO | 2007/065727 | A2 | 6/2007 |
| WO | 2010/035164 | A1 | 4/2010 |
| WO | 2015/091200 | A1 | 6/2015 |
| WO | 2017/192830 | A1 | 11/2017 |

OTHER PUBLICATIONS

Intention to Grant received for European Patent Application No. 17723866.4, dated Aug. 3, 2021, 8 pages.

* cited by examiner

CIRCULAR KNITTED GARMENT WITH APERTURES

CROSS-REFERENCE TO RELATED APPLICATIONS

This application claims priority to U.S. Provisional Patent Application No. 62/332,175, filed May 5, 2016, and U.S. application Ser. No. 15/585,405, filed May 3, 2017, the entire contents of which are hereby incorporated by reference.

STATEMENT REGARDING FEDERALLY SPONSORED RESEARCH OR DEVELOPMENT

Not applicable.

TECHNICAL FIELD

Present aspects hereof relate to circular knitted apparel items. More specifically, exemplary aspects relate to a circular knitted apparel item that is made from a circular knitted tube having apertures therein. Further aspects relate to a method of making a circular knitted sock having apertures.

BACKGROUND

Circular knitting machines are known that knit multiple circular knit rows into a tube-like shape. A variety of apparel items can be knit using circular knitting machines. One product made on these types of circular knitting machines is a sock. A typical circular knitting machine includes a number of needles positioned vertically around the circumference of a needle cylinder. The needles move up and down during the knitting operation, guided within vertical slots positioned around the circumference of the needle cylinder. Each needle has a hook positioned at the top, and a hinged latch that moves between an open and a closed position to selectively contain and release knitting thread. Circular knitting machines may also have a number of sinkers corresponding to the number of needles. The sinkers are contained in a sinker ring at the top of the needle cylinder. The sinkers cooperate with the needles to form stitches during the knitting operating. Yarn is fed into the machine and onto passing needles as the needle cylinder rotates.

A need exists to produce garments, such as socks or sleeves, having an open pattern, on circular knitting machines. The open pattern may include a number of spaced openings in the garment to satisfy ventilation, thermoregulation, comfort or aesthetic needs. Such openings could also be used for coupling layers to one another, with the openings allowing adhesives to penetrate and couple different elements or layers together. Previous efforts to provide an open pattern in a circular knitting machine involve the use of a transfer stitch, using modified needles and/or sinkers, such as disclosed in U.S. Pat. No. 7,069,751 and/or WO 2010/035164A1. In addition to the requirement of modified equipment, the circular knitting machines that are able to perform this type of transfer stitch are not able to also knit a terry stitch, without the modified needles and/or sinkers.

SUMMARY

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter. Present aspects hereof are defined by the claims.

At a high level, present aspects hereof are directed to a circular knitted apparel item, such as a sock. The apparel item has at least a first segment with multiple knit courses, and a second segment having the same multiple knit courses as the first segment. The sock has an aperture separating the first segment and the second segment, where the aperture is occupied or traversed by a strand of yarn extending from the first segment to the second segment. The first and second segments are formed by changing the circular knitting direction from one course to the next course in a reciprocating fashion, until the last course is formed, wherein the single strand of yarn moves from the last course in the current segment to the first course in a next, adjacent segment.

In some aspects, a method is disclosed for making a circular knitted apparel item, or garment, such as a sock. The method includes knitting a first course of a first segment of the garment in a first circular knitting direction. When at a desired location for an aperture in the garment, the method includes reversing the circular knitting direction to a second direction for a second knitting course. At the beginning extent of the first knitted segment, the circular knitting direction is again reversed, back to the first circular knitting direction for a third knitting course. At the location for the aperture, if the desired number of courses for the first segment has been reached, knitting continues in the first circular direction, with a crossover strand extending from the last knitted course in the first segment to the first course in a second knitted segment. If the desired number of courses has not been met, the reciprocating circular knitting continues between the location for the aperture and the beginning extent of the first knitted segment. An aperture is formed in the circular knitted garment between the first segment and the second segment. The method can be repeated to form a number of apertures between segments, separated by the apertures, where the segments are in the same band of courses.

In some other aspects, a method is disclosed for making a circular knitted apparel item, such as a sock. The method includes knitting a first course of a first segment of the garment in a first circular knitting direction. When at a desired location for an aperture in the garment, the method includes reversing the circular knitting direction to a second direction for a second knitting course. At the beginning extent of the first knitted segment, a determination is made whether a desired number of courses for the first segment has been reached. If so, the method continues knitting in the first circular direction, with a crossover strand extending from the last knitted course in the first knitted segment to a first course in a second knitted segment. If not, the method continues by reversing the circular knitting direction again, back to said first circular knitting direction for a third knitting course. The method continues reciprocating circular knitting between the location for said aperture and the beginning extent of the first knitted segment, until the desired number of courses has been knit, with a crossover strand extending from the last knitted course in the first knitted segment to the first course in a second knitted segment. An aperture is thus formed in said circular knitted apparel item between the first segment and the second segment. The method can be repeated to form a number of apertures between segments, separated by the apertures, where the segments are in the same band of courses.

BRIEF DESCRIPTION OF THE DRAWINGS

Examples are described in detail below with reference to the attached drawing figures, wherein.

DETAILED DESCRIPTION

Present aspects hereof are directed toward a circular knitted apparel item, such as a circular knitted sock. The apparel item has at least a first segment with multiple knit courses, and a second segment having the same multiple knit courses as the first segment. The apparel item has an aperture separating the first segment and the second segment, where the aperture is occupied only by a single strand of yarn extending from the first segment to the second segment. The first and second segments are formed by changing the circular knitting direction from one course to the next course in a reciprocating fashion, until the last course is formed, wherein the single strand of yarn moves from the last course in the current segment to the first course in a next, adjacent segment.

In some aspects, a method is disclosed for making a circular knitted garment, such as a sock. The method includes knitting a first course of a first segment of the garment in a first circular knitting direction. When at a desired location for an aperture in the garment, the method includes reversing the circular knitting direction to a second direction for a second knitting course. At the beginning extent of the first knitted segment, the circular knitting direction is again reversed, back to the first circular knitting direction for a third knitting course. At the location for the aperture, if the desired number of courses for the first segment has been reached, knitting continues in the first circular direction, with a crossover strand extending from the last knitted course in the first segment to the first course in a second knitted segment. If the desired number of courses has not been met, the reciprocating circular knitting continues between the location for the aperture and the beginning extent of the first knitted segment. An aperture is formed in the circular knitted garment between the first segment and the second segment. The method can be repeated to form a number of apertures between segments, separated by the apertures, where the segments are in the same band of courses.

Figure 1:
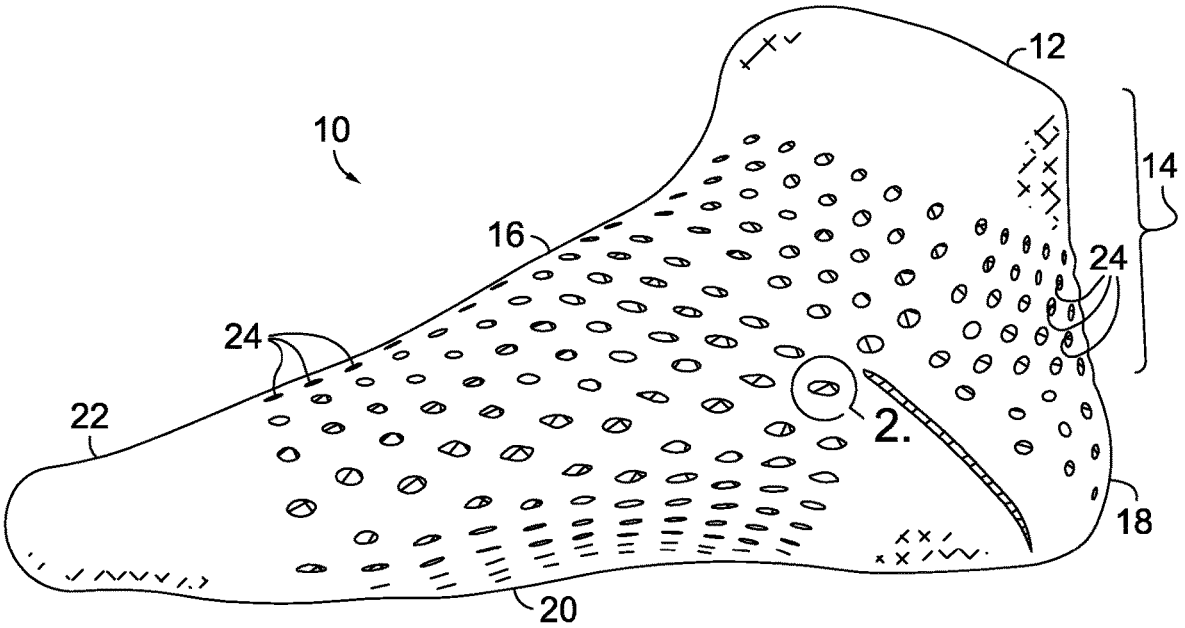
FIG. 1 depicts a side view of a circular knitted sock, in accordance with an example of present aspects.

In aspects hereof, FIG. 1 illustrates an exemplary circular knitted sock 10. Sock 10 has a cuff area 12, a leg area 14, an instep area 16, a heel area 18, a sole area 20, and a toe area 22. As shown in FIG. 1, an exemplary aspect of sock 10 includes a shorter leg area 14. In some aspects, the leg area 14 can be even shorter, or much longer, depending on the design of the sock 10.

Sock 10 has a number of apertures 24 with cross over strands formed in a circular knitting process described below. Exemplary aspects of sock 10 have apertures 24 knitted in any of cuff area 12, leg area 14, instep area 16, heel area 18, sole area 20, and/or toe area 22. The placement of apertures 24 is an aspect in the planned layout of the sock, taking into consideration the desired ventilation, comfort, weight reduction, moisture management, additional stretch characteristics and/or aesthetics of the sock 10.

Figure 2:
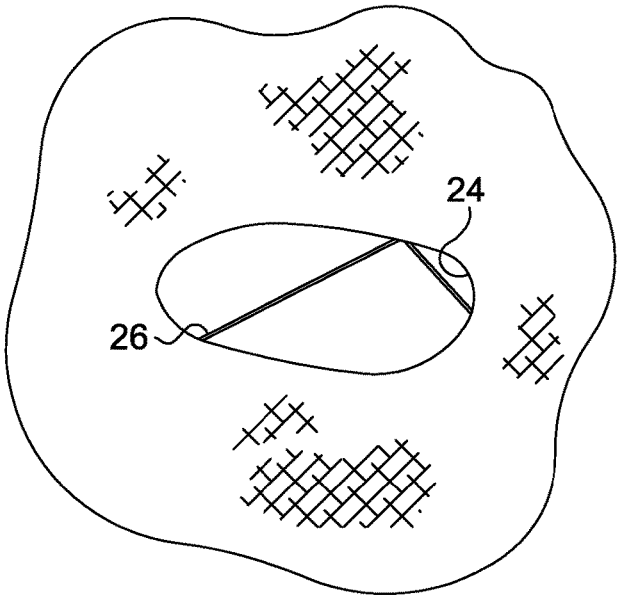
FIG. 2 depicts an enlarged view of the circled portion of the circular knitted garment depicted in FIG. 1.
Figure 3:
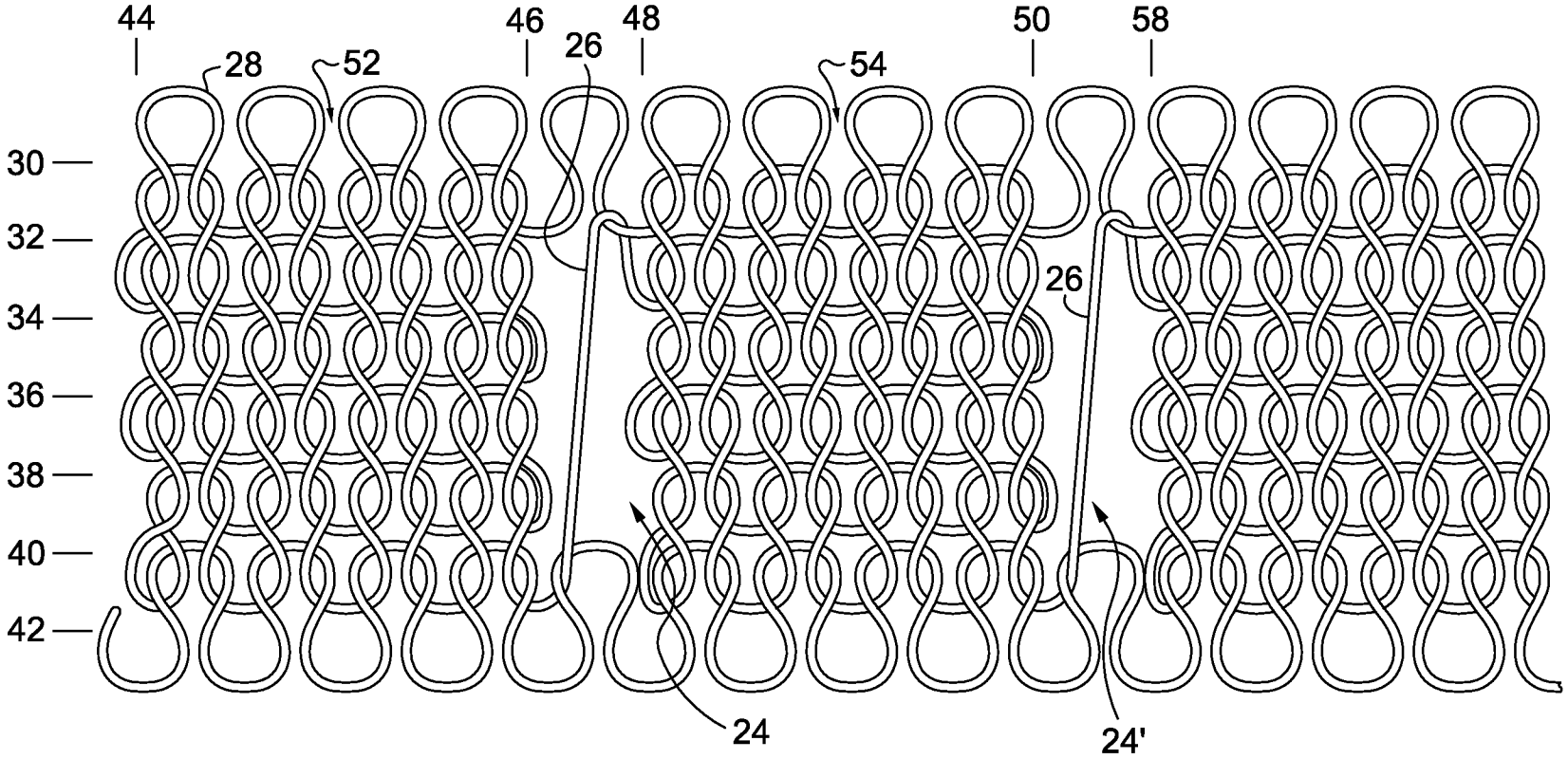
FIG. 3 depicts a further enlarged view of a portion of FIG. 2, showing individual yarn knitting paths.

FIG. 2 shows a partial, enlarged view of one of the apertures 24. As can be seen in FIG. 2, a cross over strand 26 extends partially across aperture 24. FIG. 3 shows a further enlarged, partial view of the aperture 24, showing individual yarn strands used in knitting sock 10. As shown in FIG. 3, the knitted structure of sock 10 includes a number of courses which are the meandering yarn 28, which forms a row of loops. In FIG. 3, the courses are labeled 30, 32, 34, 36, 38, 40, and 42. In a standard sock manufactured on a circular knitting machine, an entire course is knit, followed by the next course. This process continues until the entire tube structure of the sock is complete. The circular knit is basically a spiral of courses, in which each course attaches to the next course, with the knitting occurring in a circular fashion, in one direction around the needle cylinder. It is, however, sometimes desirable to knit a portion of the sock that does not include the full number of loops in a standard, full-circle course. For example, the heel area 18 may include one or more courses that include fewer loops than the instep area 16 of the sock 10. To make these courses with fewer stitches, a reciprocating technique is applied where the direction of the needle cylinder is reversed, forming a sinuous, back-and-forth path, as opposed to a spiral.

As shown in FIG. 3, in order to form apertures 24, a reciprocating knitting technique is used. Course 30 is shown as a standard, full-circle course. When a desired area for an aperture 24 is encountered, the direction of the needle cylinder is reversed. For example, as course 32 encounters the location of aperture 24, the needle cylinder is reversed in direction to form a part of course 34. As seen in FIG. 3, if course 32 is thought to start at needle position 44, the rotational direction of the needle cylinder is reversed at needle position 46. Each needle position corresponds to a wale (the predominantly vertical column of interlaced needle loops generally produced by the same needle at successive knitting cycles). This reciprocating technique continues between needle positions 44 and 46 until the span of aperture 24 is reached. At this point, the rotational direction of the needle cylinder continues from needle position 46 to needle position 48, and the cross over strand 26 extends from the needle position 46 in course 40 to the needle position 48 in course 32. A similar reciprocating technique is used to form other apertures 24. As an example, an additional aperture 24' can be formed by reciprocating between needle position 48 and needle position 50 within courses 32 through 40. Following course 40, cross over strand 26 extends from needle position 50 in course 40 to needle position 58 in course 32.

The knitted fabric can then be seen to have knitted segments between apertures 24. As shown in FIG. 3, a first knit segment 52 extends from needle position 44 to needle position 46, with courses 32 through 40. A second knit segment 54 extends from needle position 48 to needle position 50, with courses 32 through 40. Therefore, the first knit segment 52 and the second knit segment 54 occupy the same band of courses (courses 32 through 40) within the overall knit structure. A cross over strand 26 extends from the bottom course (course 40) of the first segment 52 to the top course (course 32) of the second segment 54. The gap between needle position 46 and needle position 48 in courses 32 through 40 forms an aperture 24, occupied only by cross over strand 26. Many more segments, other than first knit segment 52 and second knit segment 54 could be similarly aligned to form multiple apertures 24 among the same band of courses.

Figure 4:
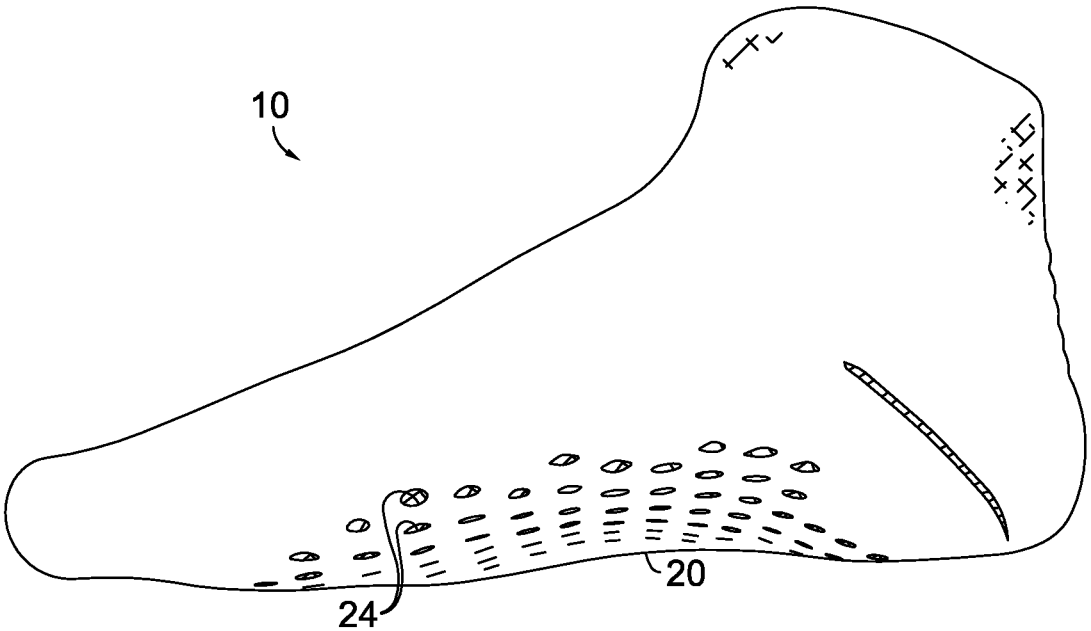
FIG. 4 depicts a side view of a circular knitted sock, in accordance with an example of present aspects.
Figure 5:
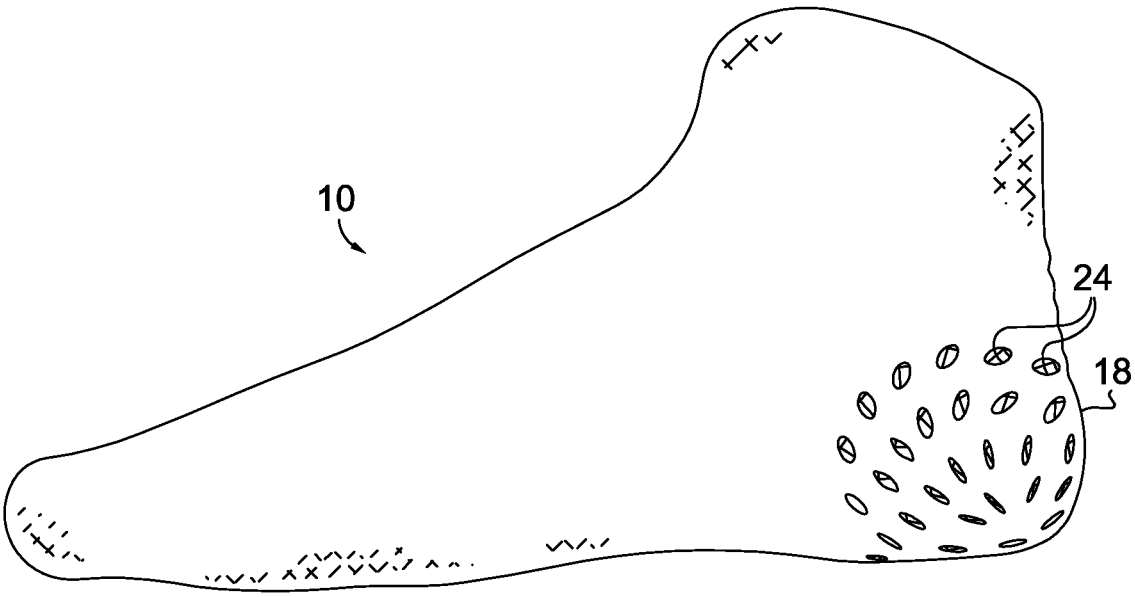
FIG. 5 depicts a side view of a circular knitted sock, in accordance with an example of present aspects.

One example of a sock 10 having multiple knitted segments, separated by apertures 24, is shown in FIG. 1. As shown in FIG. 1, the apertures 24 are spaced throughout the body of sock 10. In this exemplary aspect, the apertures 24 are spaced within a portion of leg area 14, instep area 16, heel area 18, and sole area 20. Based upon numerous design factors, it may be desirable to have apertures 24 in only certain areas of the sock 10. An example of this aspect is shown in FIG. 4, with the sock 10 having apertures 24 spaced within sole area 20. Another example of this aspect is shown in FIG. 5, with the sock 10 having apertures 24 spaced within heel area 18.

In the knitting of garments with a circular knitting machine, it may be desirable to knit different stitches. For example, it may be desirable to knit using weft (or filling) knits, which can use any of a flat or jersey stitch (plain stitch), purl stitch, rib stitch, or interlocking stitch. In another exemplary aspect, a terry stitch may be used, or may be used in only selected areas of sock 10. The methods described above can be used in both the stitches of weft knitting or terry stitches, without modifications to the needles or sinkers on the circular knitting machines. As such, the cross over strand 26 may be carried across apertures 24 created between knit segments having a variety of stitch configurations.

Figure 6:
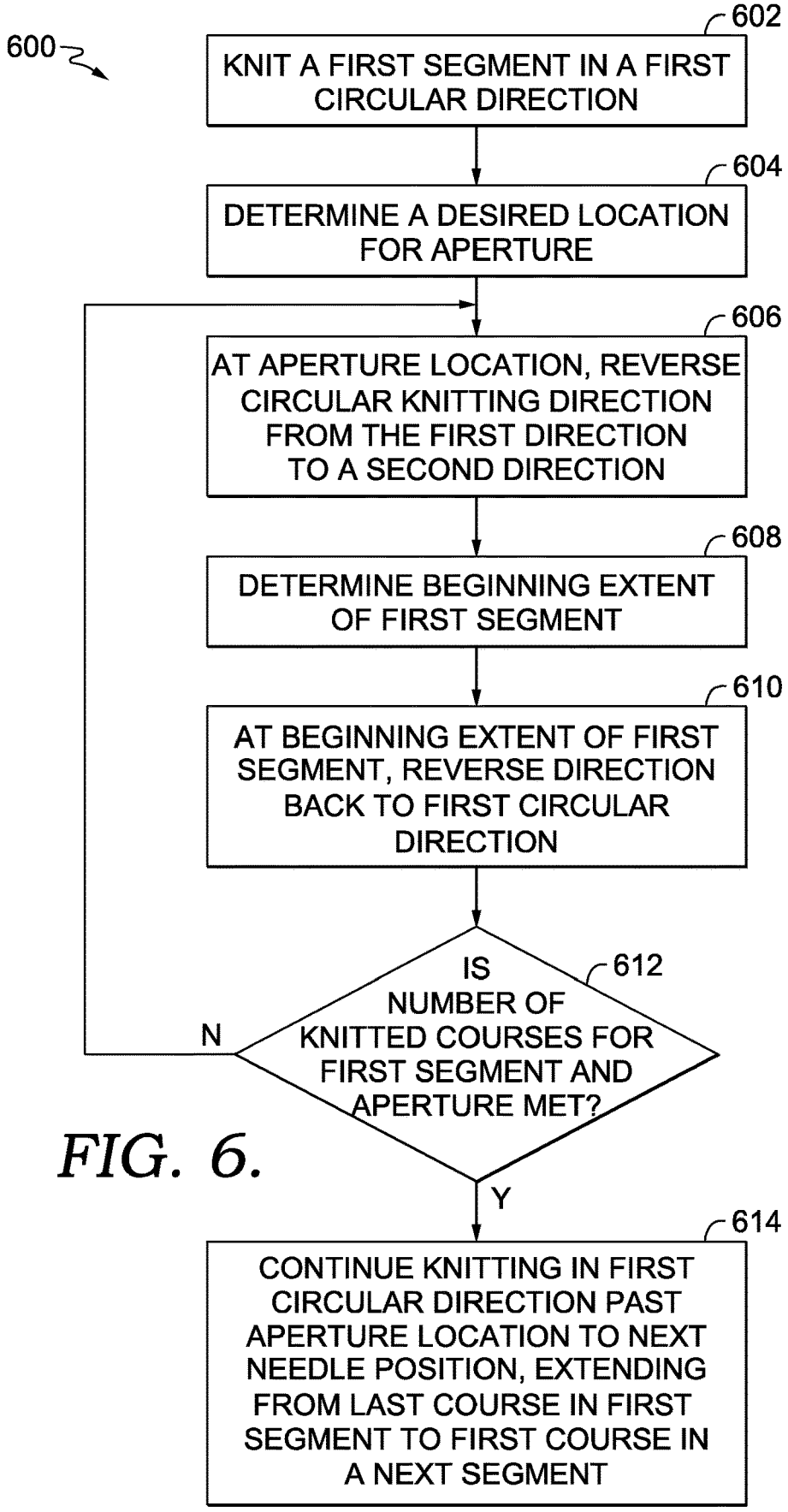
FIG. 6 depicts a flow chart illustrating a method of making a circular knitted apparel item, in accordance with an example of present aspects.

Turning now to the flow diagram of FIG. 6, a method 600 for manufacturing a circular knitted garment having apertures is provided, according to exemplary aspects. At block 602, a first segment of the garment is knitted in a first circular direction, using a circular knitting machine. As the circular knitting continues in the first circular direction, the method continues by determining at least one location for an aperture 24 in a desired location on the garment, as shown at block 604. When the circular knitting has reached the desired aperture location, the direction of the circular knitting is reversed, from the first direction to a second direction, as shown at block 606. So, the circular knitting machine reciprocates from the first circular direction to the second circular direction. As an example, shown in FIG. 3, this point is at needle position 46. The circular knitting continues in the second direction until the beginning of the current segment is determined and reached, as shown at block 608. As an example, shown in FIG. 3, this beginning extent of first knit segment 52 is at needle position 44. Once back at the beginning extent of the segment, the circular knitting direction is again reversed, from the second circular direction to the first circular direction, as shown at block 610. The method continues in the first circular direction and a determination is made, as shown at decision point 612, whether the desired number of courses for the knit segment has been reached. If not, the method continues back to block 606 in a reciprocal knitting fashion between first and second circular knitting directions, and between needle positions for the knit segment. As an example, as shown in FIG. 3, the method continues a reciprocating knitting between needle positions 44 and 46 in first knit segment 52.

If the desired number of courses for the knit segment has been reached, the method continues at block 614 by continuing to knit in the first circular direction past the desired aperture location to the next needle. The circular knitting continues from the last knit course in the current segment to the first course in the next segment, as shown at block 614, to provide a cross over strand. As an example, as shown in FIG. 3, the method continues from needle position 46 in course 40 (completing segment 52) to needle position 48 in course 32 (beginning segment 54). The method of FIG. 6 creates an aperture (such as aperture 24) within the garment between two segments (such as segments 52 and 54). The aperture 24 will be occupied by only a single yarn (such as cross over strand 26). Using this method, any number of apertures 24 can be formed in the garment, such as sock 10. A number of apertures can be formed in the same band of knit courses in the sock 10, without the need for modified sinkers or needles on the circular knitting machine. Additionally, the method allows apertures 24 to be formed using any of a number of basic stitches, such as jersey stitches or terry stitches.

Figure 7:
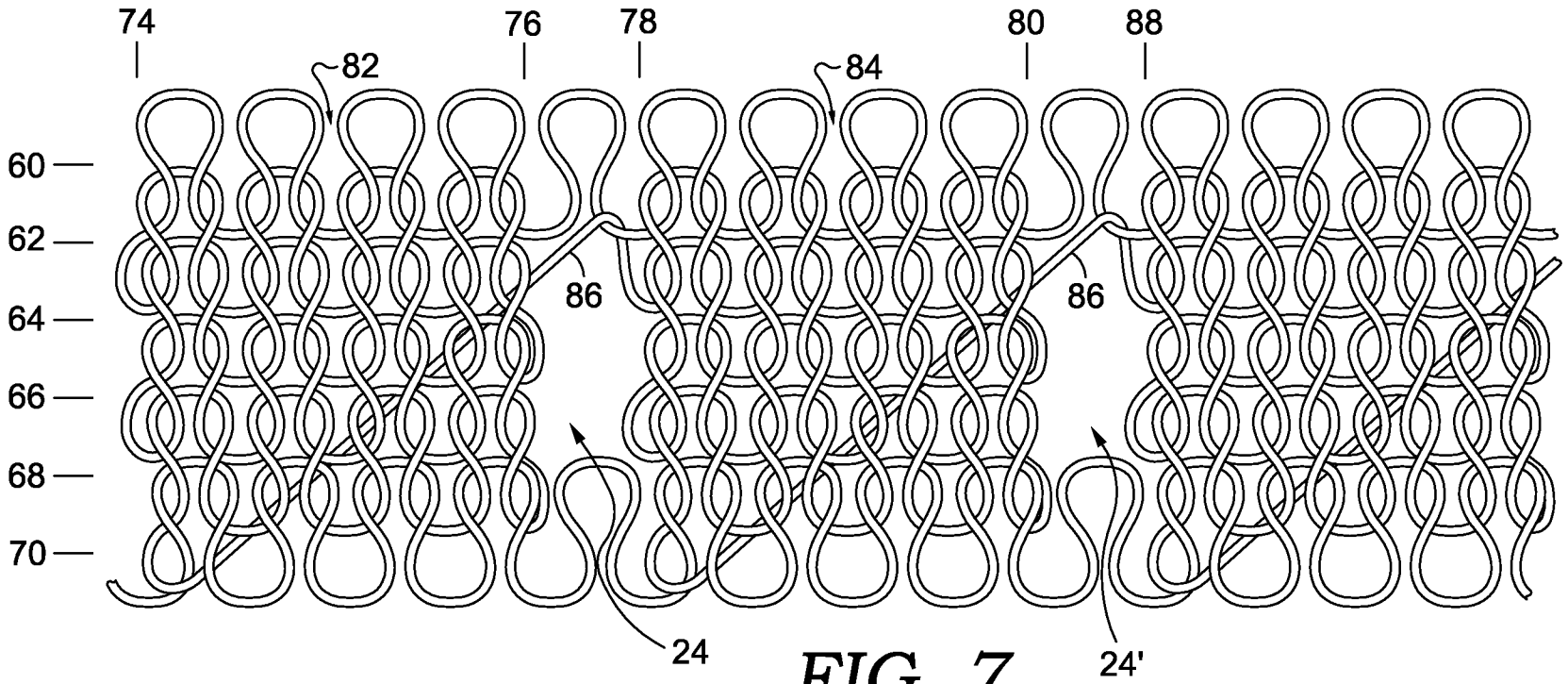
FIG. 7 is a view similar to FIG. 3 showing different aspects.

An additional aspect is shown in FIG. 7. FIG. 7 shows an alternative formation of the apertures 24. As shown in FIG. 7, in order to form apertures 24, a reciprocating knitting technique is used. Course 60 is shown as a standard, full-circle course. When a desired area for an aperture 24 is encountered, the direction of the needle cylinder is reversed. For example, as course 62 encounters the location of aperture 24, the needle cylinder is reversed in direction to form a part of course 64. As seen in FIG. 7, if course 62 is thought to start at needle position 74, the rotational direction of the needle cylinder is reversed at needle position 76. Each needle position corresponds to a wale (the predominantly vertical column of interlaced needle loops generally produced by the same needle at successive knitting cycles). This reciprocating technique continues between needle positions 74 and 76 until the span of aperture 24 is reached. At this point, the rotational direction of the needle cylinder continues from needle position 74 in course 70 to needle position 78 in course 62. The cross over strand 86 therefore extends from the needle position 74 in course 70 to the needle position 78 in course 62. A similar reciprocating technique is used to form other apertures 24. As an example, an additional aperture 24' can be formed by reciprocating between needle position 78 and needle position 80 within courses 62 through 70. Following course 70, cross over strand 86 extends from needle position 78 in course 70 to needle position 88 in course 62.

Like FIG. 3, the knitted fabric of FIG. 7 can then be seen to have knitted segments between apertures 24. As shown in FIG. 7, a first knit segment 82 extends from needle position 74 to needle position 76, with courses 62 through 70. A second knit segment 84 extends from needle position 78 to needle position 80, with courses 62 through 70. Therefore, the first knit segment 82 and the second knit segment 84 occupy the same band of courses (courses 62 through 70) within the overall knit structure. A cross over strand 86 extends from the bottom course (course 70) of the first segment 82, across segment 82 to the top course (course 62) of the second segment 84. The gap between needle position 76 and needle position 78 in courses 62 through 70 forms an aperture 24, occupied only by cross over strand 86. Many more segments, other than first knit segment 82 and second knit segment 84 could be similarly aligned to form multiple apertures 24 among the same band of courses.

Figure 8:
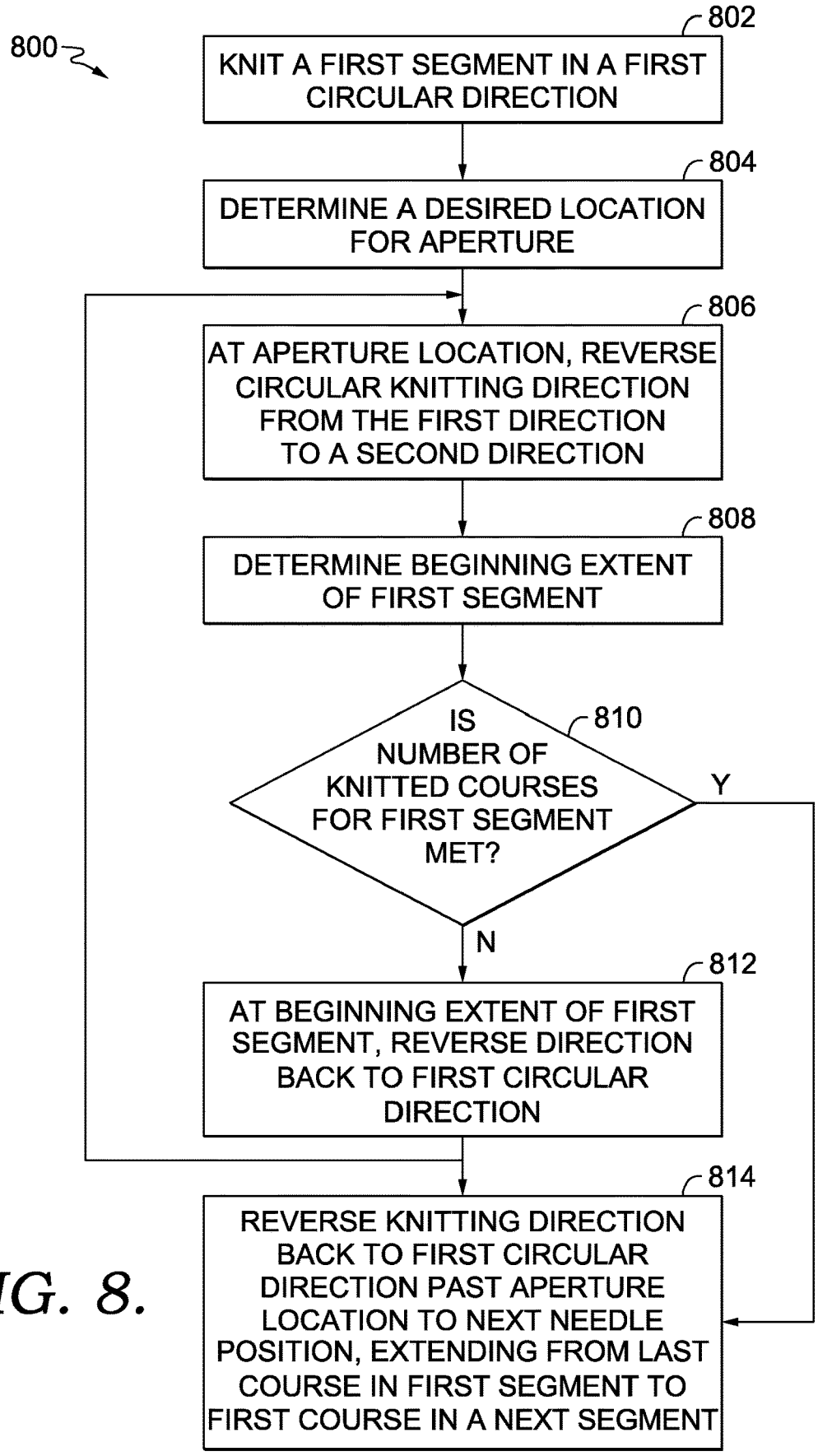
FIG. 8 depicts a flow chart illustrating a method of making a circular knitted apparel item, in accordance with an example of present aspects.

Turning now to the flow diagram of FIG. 8, a method 800 for manufacturing a circular knitted apparel item having apertures as shown in FIG. 7 is provided, according to exemplary aspects. At block 802, a first segment of the garment is knitted in a first circular direction, using a circular knitting machine. As the circular knitting continues in the first circular direction, the method continues by determining at least one location for an aperture 24 in a desired location on the garment, as shown at block 804. When the circular knitting has reached the desired aperture location, the direction of the circular knitting is reversed, from the first direction to a second direction, as shown at block 806. So, the circular knitting machine reciprocates from the first circular direction to the second circular direction. As an example, shown in FIG. 7, this point is at needle position 76, for segment 82. The circular knitting continues in the second direction until the beginning of the current segment is determined and reached, as shown at block 808. As an example, shown in FIG. 7, this beginning extent of first knit segment 82 is at needle position 74. Once at the beginning of the current segment a determination is made, as shown at decision point 810, whether the desired number of courses for the knit segment has been reached. If the desired number of courses for the knit segment has not been reached, the circular knitting direction is again reversed, from the second circular direction back to the first circular direction, as shown at block 812. The method continues knitting in the first direction until the aperture location is reached and the process continues at block 806. If the desired number of courses for the first segment has been reached, the circular knitting direction is again reversed, from the second circular direction back to the first circular direction. In this aspect, the circular knitting continues in the first direction past the desired aperture location to the next needle past the aperture. The circular knitting thus jumps from the last knit course in the current segment to the first course in the next segment, as shown at block 814, to provide a cross over strand. As an example, as shown in FIG. 7, the method continues from needle position 74 in course 70 (completing segment 82) to needle position 78 in course 62 (beginning segment 84). The method of FIG. 8 creates an aperture (such as aperture 24) within the garment between two segments (such as segments 82 and 84). The aperture 24 will be occupied by only a single yarn (such as cross over strand 86). Using this method, any number of apertures 24 can be formed in the garment, such as a sock 10. A number of apertures can be formed in the same band of knit courses in the sock 10, without the need for modified sinkers or needles on the circular knitting machine. Additionally, the method allows apertures 24 to be formed using any of a number of basic stitches, such as jersey stitches or terry stitches.

Figure 9:
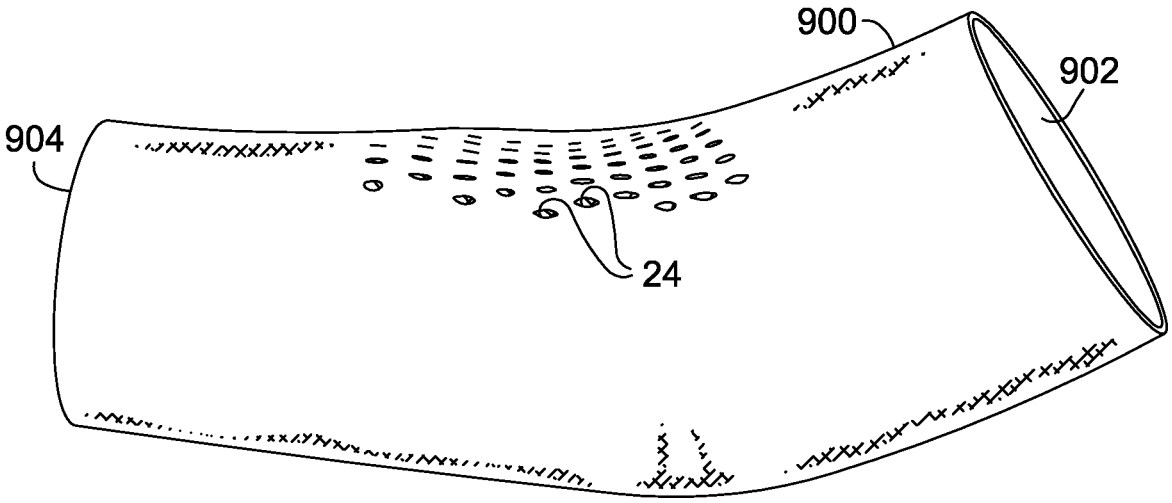
FIG. 9 depicts a side view of an alternative knitted apparel item.

FIG. 9 illustrates another aspect, showing a circular knit apparel item 900 in a sleeve configuration. Sleeve 900 is knit in a circular knitting machine and has open ends 902 and 904. Sleeve 900 has a number of apertures 24, shown here to correspond in location to the internal bend of the sleeve, which might be desirable for thermoregulation, as an example. Like other aspects above, apertures 24 could be located and spaced throughout sleeve 900 in a variety of ways. Apertures 24 could be knit, for example, using the methods of FIG. 6 or 8, having a configuration, for example, as shown in FIG. 3 or 7.

Present aspects hereof have been described in relation to particular examples, which are intended in all respects to be illustrative rather than restrictive. From the foregoing, it will be seen that the present aspects are well adapted to attain all the ends and objects set forth above, together with other advantages, which are obvious and inherent to the system and method. It will be understood that certain features and subcombinations are of utility and may be employed without reference to other features and subcombinations. This is contemplated by and is within the scope of the claims.

What is claimed is:

1. A circular knitted garment, comprising:

a first segment of the garment having multiple knit courses;

a second segment of the garment having the same multiple knit courses as the first segment; and an aperture separating the first segment and the second segment, wherein a strand forming the first segment extends from the last course of the first segment over and across a plurality of knit courses of the first segment and across the aperture to the first course of the second segment.

2. The garment of claim 1, wherein the first and second segments are formed by changing the circular knitting direction from one course to the next course, until the last course is formed, wherein the single strand of yarn moves from the last course in the first segment to the first course in a next, adjacent second segment.

3. The garment of claim 2, further comprising a plurality of circular knit segments occupying the same courses, with adjacent segments separated by an aperture occupied only by a single strand of yarn extending from the last course in one segment to the first course in an adjacent segment.

4. The garment of claim 3, wherein the garment has a plurality of apertures formed in a plurality of different selected areas on the garment.

5. The garment of claim 4, wherein the garment is a sock.

6. The garment of claim 5, wherein at least one of the selected areas is a heel of the sock.

7. The garment of claim 6, wherein the aperture separating the first segment and the second segment is at least one missing wale between the first segment and the second segment.

8. The garment of claim 4, wherein the garment is a sleeve.

9. The garment of claim 1, wherein the knit courses are made with a weft stitch.

10. The garment of claim 1, wherein the knit courses are made with a terry stitch.

11. A circular knitted sock, comprising:

a first segment of the sock having multiple knit courses;

a second segment of the sock having the same multiple knit courses as the first segment; and an aperture separating the first segment and the second segment, wherein a strand forming the first segment extends from the last course of the first segment over and across a plurality of knit courses of the first segment and across the aperture to the first course of the second segment.

12. The sock of claim 11, wherein the first and second segments are formed by changing the circular knitting direction from one course to the next course, until the last course is formed, wherein the single strand of yarn moves from the last course in the first segment to the first course in a next, adjacent second segment.

13. The sock of claim 12, further comprising a plurality of circular knit segments occupying the same courses, with adjacent segments separated by an aperture occupied only by a single strand of yarn extending from the last course in one segment to the first course in an adjacent segment.

14. The sock of claim 13, wherein the sock has a plurality of apertures formed in a plurality of different selected areas on the sock.

15. The sock of claim 14, wherein at least one of the selected areas is a heel of the sock.

16. The sock of claim 11, wherein the aperture separating the first segment and the second segment is at least one missing wale between the first segment and the second segment.

17. The sock of claim 11, wherein the knit courses are made with a weft stitch.

18. The sock of claim 11, wherein the knit courses are made with a terry stitch.

* * * * *